US005254398A

United States Patent [19]

Gaisser

[11] Patent Number: 5,254,398

[45] Date of Patent: Oct. 19, 1993

[54] WOVEN MULTILAYER PAPERMAKING FABRIC HAVING INCREASED STABILITY AND PERMEABILITY AND METHOD

[75] Inventor: Hermann Gaisser, Reutlingen, Fed. Rep. of Germany

[73] Assignee: Wangner Systems Corporation, Greenville, S.C.

[21] Appl. No.: 885,276

[22] Filed: May 18, 1992

Related U.S. Application Data

[63] Continuation of Ser. No. 763,039, Aug. 5, 1985, Pat. No. 5,114,777.

[51] Int. Cl.[5] ..... D03D 3/04; D21F 3/02; D21F 7/08

[52] U.S. Cl. ..... 428/255; 139/35; 139/383 R; 139/420 A; 139/383 A; 162/382; 162/383; 162/900; 428/257; 428/258; 428/259

[58] Field of Search ..... 162/DIG. 1, 382, 383, 162/900; 139/35, 383 R, 420 A, 383 A; 428/255, 257, 258, 259

[56] References Cited

U.S. PATENT DOCUMENTS 5,114,777 5/1992 Gaisser ..... 428/137

*Primary Examiner*—James C. Cannon

*Attorney, Agent, or Firm*—Cort Flint; Henry S. Jaudon

[57] ABSTRACT

A papermaking fabric and method therefor is disclosed which may be used as a support fabric or a carrier fabric for paper material on a papermaking machine. The fabric, designated generally as (A) includes a first layer (B) of warp yarns (32, 34, 36, and 38) extending in a machine direction. A second layer (C) of warp yarns (42, 44, 46 and 48) is included in the fabric vertically spaced from the first layer. The warp yarns of the first and second layer form stacked pairs (52, 54, 56, and 58) which reinforce the fabric in a machine direction to enhance its stability. At the same time, the stacked pairs may be spaced apart in a cross-machine direction sufficiently to provide a desired degree of openness and fabric permeability. Fabric openness in the range of thirty percent or more of the total fabric area can be had in accordance with the fabric of the present invention without sacrificing the structural stability. A single weft system (40) is interwoven with the first and second warp layers (B and C) in a balanced weave pattern that maintains the warp yarns of the respective layers stacked. The balanced weave pattern of the weft resists lateral shifting of the stacked warp yarns to prevent them from becoming side-by-side. In a preferred embodiment, the fabric is utilized as a base fabric for a resinous layer 62 which supports the paper and has an embossed surface 64 which makes a corresponding pattern in the paper, such as in towel grade paper.

11 Claims, 2 Drawing Sheets

Fig. 3-A

WOVEN MULTILAYER PAPERMAKING FABRIC HAVING INCREASED STABILITY AND PERMEABILITY AND METHOD

This is a continuation of copending application Ser. No. 07/763,039, filed on Aug. 5, 1985, now U.S. Pat. No. 5,114,777, issued on May 19, 1992.

BACKGROUND OF THE INVENTION

The invention relates to woven permeable fabric which supports paper stock during the manufacture of paper on a papermaking machine. In particular, the invention is directed to a multilayer fabric having increased structural stability in a machine direction in which the fabric travels on the papermaking machine while still affording a high degree of permeability which facilitates drying of the paper. The fabric of the invention has application as a support fabric for directly supporting a paper web on a papermaking machine. The fabric has further application as a carrier fabric for carrying a layer of material which contacts the paper instead of the paper contacting the fabric directly. A carrier fabric is typically utilized in the manufacture of embossed paper products as a base fabric. In such an application, a layer of material is embedded in or carried on the base fabric which is embossed to imprint a desired pattern on the paper sheet contacted by the embossed layer. The load in the machine direction is carried mainly by the base fabric and not the embossed layer. For drying purposes, the carrier fabric must have a high degree of openness and air permeability so that sufficient air is delivered through the base fabric and the embossed layer, which is also permeable for drying. Carrier fabric must have sufficient load bearing capability for bearing the loads in the machine direction which are the most severe.

Heretofore, single layer fabrics have been utilized as carrier and support fabrics which have one warp system and one weft system. In order for a single layer of fabric to have an open area above thirty percent the machine direction yarns become spread apart to such an extent that fabric stability in the machine direction becomes too low. In order to achieve desired projected open areas above thirty percent, a single layer fabric must be made of thin warp and weft yarns (e.g. 0.10 to 0.20 mm diameter). The single layer fabrics have utilized low warp and weft counts per centimeter, for example, 20 ends or picks per centimeter. Under these conditions, the single layer fabric tends to stretch unacceptably while traveling in the machine direction. If additional machine direction yarns are utilized in order to strengthen the fabric, the open area of the fabric is reduced resulting in the permeability of the fabric being below desired levels.

A single layer fabric is disclosed in U.S. Pat. No. 4,281,688 having a plurality of dominating floats on opposing faces of the fabric. Every alternating weft has a long knuckle to one face, and every other weft has a long knuckle to the opposite face. The projected open area of the fabric is limited.

U.S. Pat. No. 4,314,589 discloses a double layer fabric having two weft layers and a single warp layer. The warps lie next to each other almost without any spacing between adjacent warps providing little or no projected open area. U.S. Pat. No. 4,359,069 discloses a double layer fabric having a single warp yarn system extending in the machine direction and a double layer weft yarn system in the cross-machine direction. The yarns of the single layer warp system are spaced apart from one another with a yarn density of 0.50 to 0.65. This warp density in the machine direction cannot be lowered, as otherwise the fabric stability would drop too much. This provides a projected open area of only 13 to 25 percent of the total fabric area. The warp yarns in the machine direction have to bear the load when the fabric runs on the papermaking machine. U.S. Pat. No. 4,359,069 teaches recessing the single layer warp system which extends in the machine direction between the two layers of the weft yarn so the warp yarns are removed from wear, it is thought that this will enable the warp yarns to better withstand the longitudinal stresses and provide a longer fabric life. U.S. Pat. No. 4,344,465 discloses a double layer forming fabric having two function sides. However, there is only one layer of load bearing machine direction yarns. There are machine direction yarns on the paper support side of the fabric which do not bear loads.

International Publication No. (PCT) WO 80/01086, U.S. Pat. No. 4,356,225, and European Patent Application No. EP 0 123 431 A2, describe multilayer wet felt designs. The technology for weaving multilayered fabrics for felt bases was begun primarily to increase void volume under pressure. These press felt base fabrics are preferably woven endless. Due to the quite different objectives in designing these fabrics, none of these described designs show a structurally stable weave pattern and a projected open area in the range of thirty percent or more as in the case of the present invention.

European Patent Application No. EP 0 135 231 A1 discloses a single layer flat carrier fabric used as a carrier of an embossed layer which imprints paper.

Thus, it can be seen that the prior single layer and multilayer fabrics are limited in their capacity to provide both high degrees of projected open area and structural stability in the machine direction.

Accordingly, an important object of the present invention is to provide a method and fabric with improved fabric stability in the machine direction while maintaining a projected open fabric area which facilitates use of the fabric as a support or carrier fabric on papermaking machines.

Still another important object of the present invention is to provide a woven multilayered papermaking fabric having an increased number of load bearing warp yarns extending in a machine direction while maintaining a sufficient distance between adjacent warp yarns to allow for a projected open area of at least thirty percent of the total fabric area.

Still another important object of the present invention is to provide a highly permeable woven fabric for use on paper machines and the like and method therefor wherein the load bearing machine direction yarns are doubled in their density without a decrease in the projected open area of the fabric.

Yet another important object of the present invention is to to provide a woven multilayered papermaking fabric having a first warp layer and a second warp layer, both of which contain load bearing warp yarns extending in a machine direction, which are interwoven with a single weft yarn which maintains the warp yarns of the first and second layers in stacked pairs which may be spaced apart sufficiently to provide a desired open area in the fabric.

SUMMARY OF THE INVENTION

A highly permeable woven multilayer papermaking fabric having increased fabric stability in a machine direction and method therefor is disclosed. The fabric includes a paper support side and a roller contact side facilitating travel as an endless belt in the machine direction. The fabric comprises a first warp layer of first load bearing warp yarns extending in the machine direction on the paper support side of the fabric, and a second layerof second load bearing warp yarns extending in the machine direction on the roller contact side of the fabric. Stacked warp yarn pairs are defined by respective ones of the first and second warp yarns of the first and second warp layers arranged in a superposed position one over the other. The stacked warp yarn pairs are spaced apart next adjacent one another in a cross-machine direction in the fabric to provide a desired fabric open area. A warp balancing weft yarn is interwoven with the first and second warp layers to bind the first and second warp yarns in the stacked pairs. The warp balancing weft yarn is interwoven in a weave pattern which maintains the warp yarns stacked upon one another and in general vertical alignment in the weave pattern. A fabric having increased fabric stability in the machine direction is provided yet having a high degree of openness and permeability in a range greater than thirty percent of the total fabric area.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3A is a top plan view of the fabric of FIG. 3.

DESCRIPTION OF A PREFERRED EMBODIMENT

The invention relates to a woven multilayer fabric and method for a papermaking fabric and the like. In particular,, the fabric has application to the dryer section of a papermaking machine wherein the fabric may be used as a support fabric or a carrier fabric. Since the details of papermaking machines are well known in the art., only so much of a papermaking machine as is necessary to an understanding of the invention will be illustrated.

Figure 1:
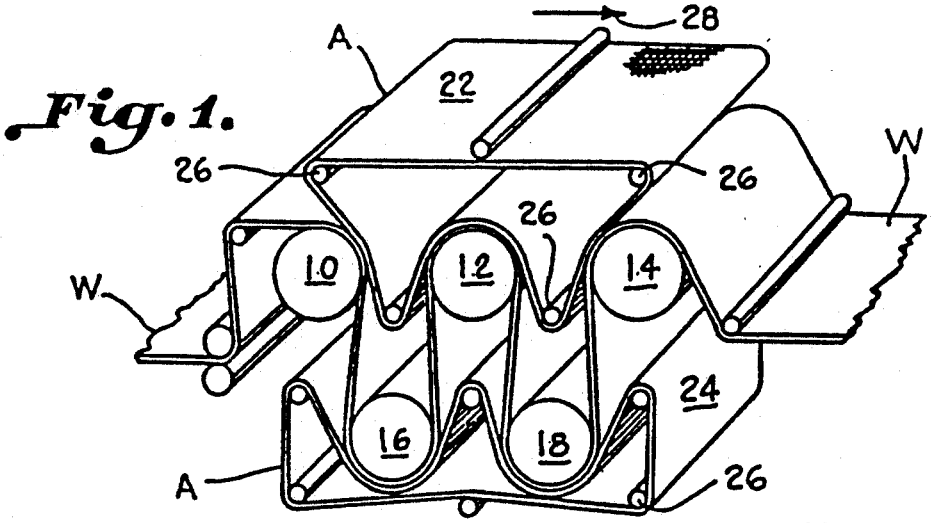
FIG. 1 is a perspective view illustrating a partial dryer section of a conventional papermaking machine utilizing a woven multilayer fabric and method in accordance with the present invention.
Figure 2:
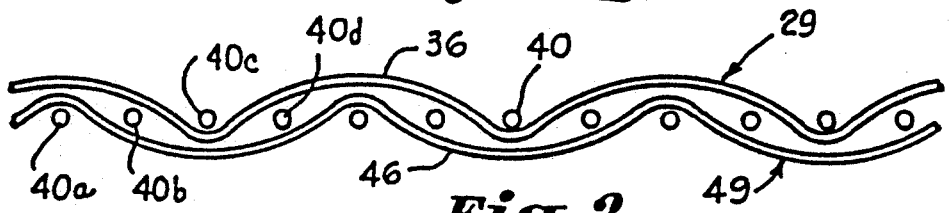
FIG. 2 is an extended sectional view as may be taken along line 2—2 of FIG. 4.

Accordingly, FIG. 1 is a simplified illustration of a portion of a dryer section of a papermaking machine wherein a continuous sheet like web W of paper stock material is traveling from left to right. In practice, several dryer sections may be utilized in succession to dry the paper in stages. Numerous different types of dryers may be utilized in a dryer section of a conventional papermaking machine, and the particular dryer illustrated in FIG. 1 is for purposes of explanation only. The dryer section includes an upper and lower array of horizontally disposed heated dryer cylinders which may be either of a perforated or imperforated construction. The upper array of heated cylinders includes cylinders 10, 12, and 14. The lower array includes cylinders 16 and 18. The continuous web W of paper is received from a press section and passed in a serpentine manner about the dryer cylinders as illustrated. Water and other fluids within the paper web are evaporated due to the paper contacting the heated cylinders. The paper web W is guided through the dryer section and held in contact with the heated cylinders by means of an upper permeable dryer fabric 22 and a lower permeable dryer fabric 24. Dryer fabrics 24 and 22 are identical in their construction, and are constructed in accordance with the fabric and method of the present invention as will be more fully explained hereafter. Since the fabrics are identical, description of the invention will be made by reference to fabric 22 only which hereinafter is referred to as fabric A. By contacting the paper web W, the dryer fabrics press and maintain the web in intimate heat transfer relationship with the dryer cylinders whereby the cylinders remove water or other fluids from the web. The drying process is outwardly from the heated cylinders through the paper web and through the dryer fabric. Thus sufficient permeability must be had in order to facilitate drying of the fabric.

The fabric is in the form of endless belts which travel over machine belt 26 rollers. The fabric travels in its endless belt configuration in a machine direction as shown in the direction of arrow 28. During the repeated travel of the fabric over the belt rollers in the machine direction, the fabric comes under considerable stress in the machine direction due to the motion of the endless travel and the heat transfer from the heated cylinders. If the fabric should stretch out of shape, its use as a paper support or carrier fabric becomes diminished to the point of uselessness.

While the above describes the use of the fabric in a conventional dryer section of a papermaking machine, the fabric has particular advantages for use in through air drying systems for tissue and towel grades of paper. In this application, the fabric is used as a carrier fabric with an embossed layer embedded in the fabric which imprints the paper web. The use of a carrier fabric and an embossed layer in a papermaking machine with a through air dryer is illustrated in European Patent Application, Publication No. 0 135 231, filed on Aug. 16, 1984.

Figure 3:
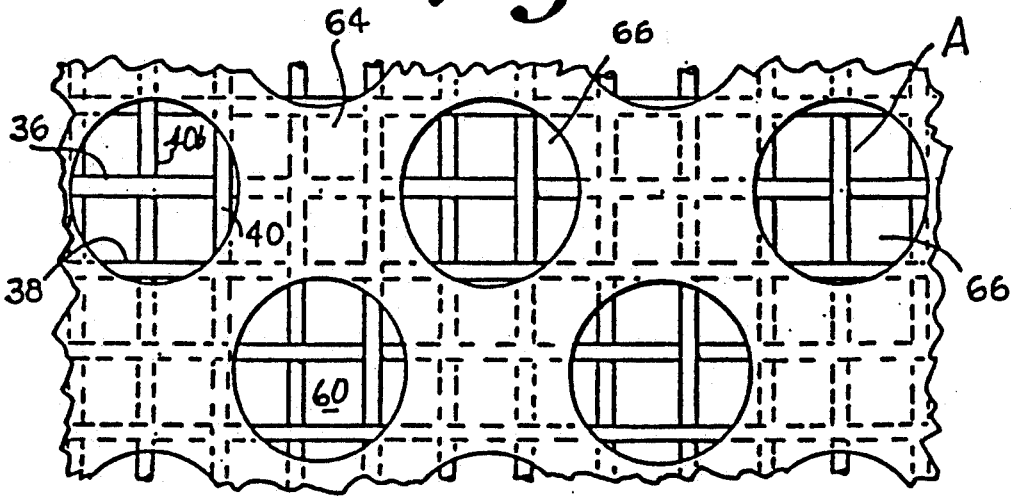
FIG. 3 is an elevation illustrating the woven multilayer fabric and method of the present invention applied as a carrier fabric.
Figure 3:
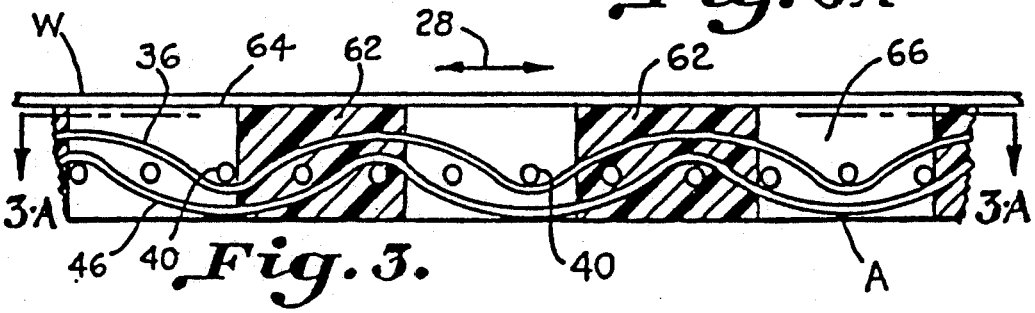

As a base fabric, fabric permeabilities in the range of 1000 to 1200 cfm can be had in accordance with the instant invention with the increased stability in the machine direction provided by the double warp system, and 30 percent or more open area. The base fabric carrying a resinous embossed layer as shown in FIGS. 3 and 3A has a lower permeability but is still sufficient for drying purposes. This decrease of air permeability between the base fabric without the resinous layer and the base fabric carrying the resinous layer depends on the size, shape, and pattern of the holes in the resinous layer.

Figure 4:
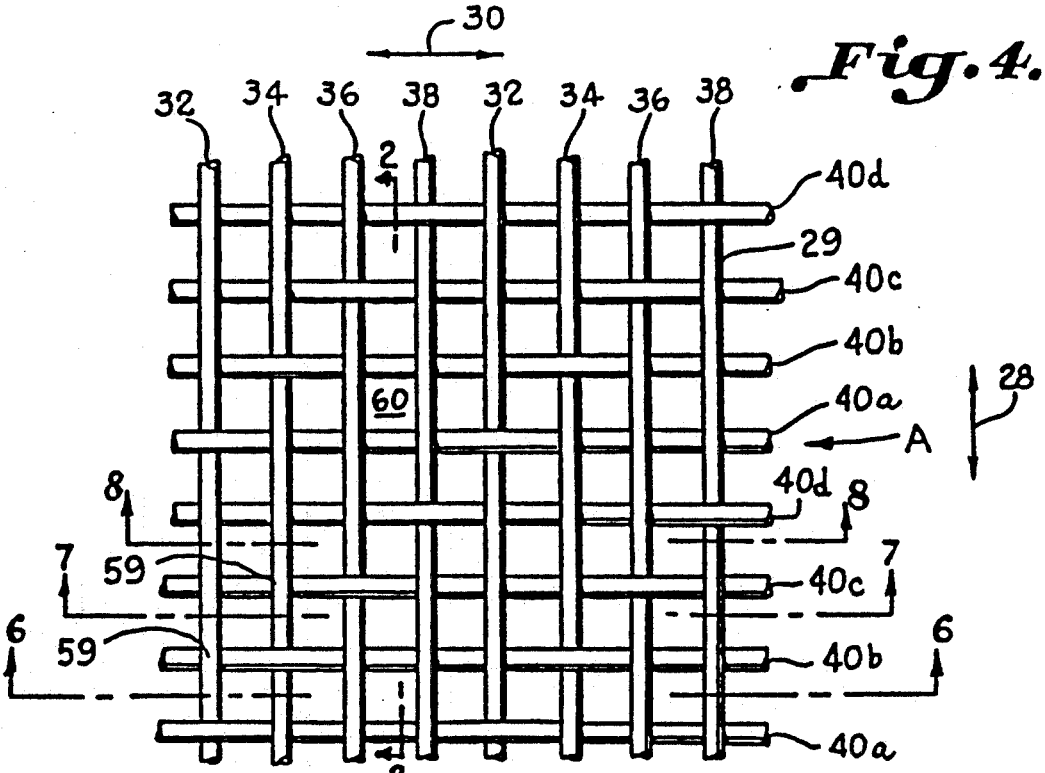
FIG. 4 is a plan view illustrating woven multilayer papermaking fabric and method in accordance with the present invention.
Figure 5:
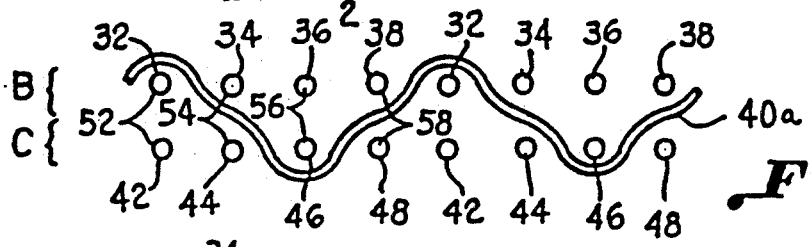
FIG. 5 is an end sectional view of the fabric of FIG. 4.

Referring now in more detail to the drawings, FIG. 4 is a top plan view from a paper support side designated generally as 29 of a fabric illustrating woven multilayer fabric A constructed in accordance with the present invention. The machine direction is indicated by the arrow 28 and the cross-machine direction is illustrated by arrow 30. It can thus be seen that a first warp layer B consisting of first warp yarns 32, 34, 36 and 38, repeatedly numbered across the fabric as illustrated in FIGS. 4–8, lies on the paper support side of the fabric A. The warp yarns extend in the machine direction 28. The warp yarns are woven in a four-shed repeat with a single weft system which consists of a weft yarn 40. The weft 40 is woven in four picks 40*a*, 40*b*, 40*c*, and 40*d* which repeats itself.

As can best be seen in FIG. 4–8 and 2, there is a second warp layer C which consists of a number of second warp yarns 42, 44, 46, and 48, repeatedly numbered across the fabric, extending in the machine direction. The second warp layer is the roller contact side designated generally as 49 of the fabric which contacts the belt rollers 26 when traveling in the machine direction in an endless manner.

As can best be seen in FIGS. 5 through 8, the warp yarns of the first warp layer B and the warp yarns of the second warp layer C are stacked on top of each other. The warp yarns 32 and 42 define a first stacked pair 52. The warp yarns 34 and 44 define a second stacked pair 54. The warp yarns 36 and 46 define a third stacked pair 56. The warp yarns 38 and 48 define a fourth stacked pair 58. The warp balancing weft yarn 40 interweaves with the warp yarns of the respective stacked pairs in such a manner that a balanced weave is provided wherein the warp yarns, 32 and 42, for example, are maintained in their stacked configuration. The tendency of the warp yarns to shift laterally in the warp yarn pairs is prevented by the illustrated balanced weave pattern of the weft yarn 40.

By noting the over, between, under, between repeat pattern of the alternating picks (FIGS. 5–8) of the warp balancing weft system, the binding of the warp yarns into vertically stacked pairs and balancing effect of the weave pattern can readily be seen. The balanced weave pattern maintains the stacked configuration of the warps. The cross-over point 59 of the weft is staggered in the weft direction across the warps as can best be seen in FIG. 4. A variation of the above balanced weave pattern can be achieved by interchanging the pick 40*c* shown in FIG. 7 with the pick 40*d* shown in FIG. 8. This results in a broken, staggered pattern of the cross-over points of the weave in the weft direction. In this pattern, the first two cross-over points are in a straight diagonal. The third cross-over point is shifted over a third warp to a fourth warp and then the cross-over point is shifted back in a diagonal to the third warp. This weave pattern also maintains the warp yarns in a stacked pair in a suitably stacked configuration. However, in this weave pattern, the two warp yarns pass together between two adjacent picks. In the first described balanced weave pattern, there are no two picks between which the warp yarns simultaneously pass, which provides a slightly better balanced weave pattern.

Figure 6:
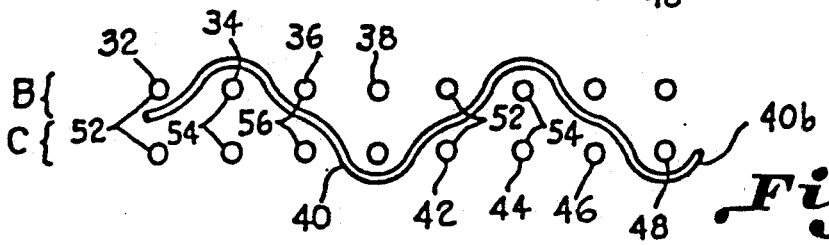
FIG. 6 is a sectional view taken along line 6—6 of FIG. 4.
Figure 7:
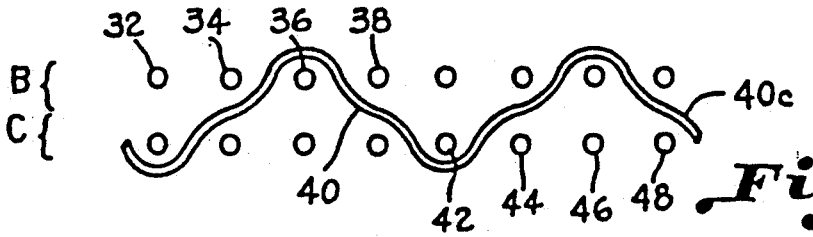
FIG. 7 is a sectional view taken along line 7—7 of FIG. 4.
Figure 8:
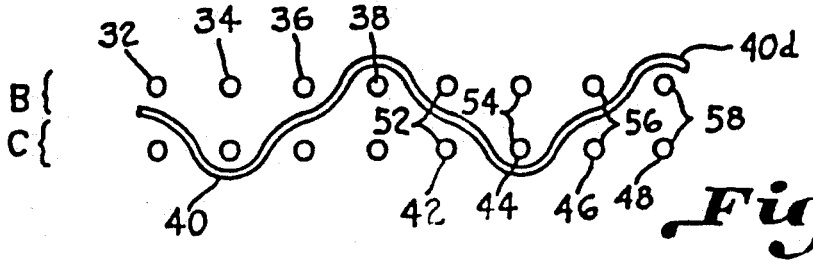
FIG. 8 is a sectional view taken along line 8—8 of FIG. 4.

The balanced weave pattern of the weft yarn 40 consists of a four-shed repeat pattern wherein a first pick 40*a* of the weft yarn 40 passes over a first stacked pair 52, between the warp yarns of the second stacked pair 54, under the yarns of the third stacked pair 56, and between the yarns of the fourth stacked pair 58. In the broadest sense, the pattern passes over and under every other pair of stacked warp yarns while passing between the yarns of an intermediate stacked pair disposed between every other stacked pair. By passing between the yarns after passing over and under the previous pair of stacked yarns, the tendency of the warp yarns to shift laterally beside each other is substantially reduced thus maintaining the warp yarns on top of each other. FIG. 6 shows the second pick of the weft yarn 40 at 40*b*. FIG. 7 illustrates the third pick of the weft yarn at 40*c*, and FIG. 8 the fourth pick of the weft yarn at 40*d*.

Referring again to FIG. 4, it can be seen that the stacked pairs of warp yarns are spaced considerably in the cross-machine direction 30 so that open areas 60 are provided which provide a projected open area of thirty percent or more of the total fabric area. Since the load bearing warp yarns 32 through 38 and 42 through 48 are stacked underneath each other, the effective density of load bearing warp yarns is doubled without decreasing the open area of the fabric. Increased structural stability is provided in the machine direction without decrease in the permeability or open area of the fabric. This is particularly advantageous when the fabric is used as a carrier fabric for another layer 62 as can best be seen in FIG. 3. The layer 62 is typically a material such as resin having an embossed outer surface 64 which imprints a pattern upon the paper web W supported thereon. The layer 62 is perforated at 66 to allow for the flow of moisture and air therethrough. The effective permeability of the layer 62 and drying of the paper W thereon will be sufficiently provided only if the open area and permeability of the carrier fabric A is sufficient. Not only is the open area of the carrier fabric constructed in accordance with the method of the present invention adequate, but the structural stability of the fabric of the instant invention is particularly advantageous for carrying the layer 62 due to the extra loads imparted thereon in the machine direction.

Various combinations of materials and yarn diameters and shapes of yarns may be utilized in the fabric described herein. For example, the warp systems B and C may be of one diameter, and the weft system 40 may be of a larger diameter. This provides a stiffer weft yarn which will place more crimp in the warp yarns. This results in a decided advantage when the ends of the fabric are joined together in an endless manner at a seam. The crimp warp yarns are more easily interwoven together in the endless fabric and interlocked at the seam. Other variations may include the warp system B and the weft system 40 being identical, and the warp system C being different either in material, diameter, or shape. Likewise, the warp system C and weft system 40 may be identical, with the warp system B being different. Furthermore, each of the warp system B, warp system C, and weft 40 can be different.

A preferred material for the construction of the fabric is polyester. However, polyamid, and high heat resistant materials such as Kevlar or Nomex brands, as well as other materials which are well known in a use for paper fabric manufacturing, may be utilized. At present, round, oval, and rectangular shapes may be used for the warp yarns. The weft yarn may be provided in a round shape. It may be also desirable at a later date to utilize an oval or rectangular shape in the weft yarn.

A preferred range of yarn diameters is from 0.10 to 0.20 mm. Depending on the application, larger diameters of fibers may also be utilized. The diameter, shape, and material will be determined by the particular application being made of the fabric.

In accordance with the method of the present invention, a method of weaving a multilayered papermaking fabric A having a weave pattern which provides increased fabric stability in a machine direction and high fluid permeability includes the step of weaving the first warp layer B having first load bearing warp yarns extending in the machine direction and weaving the second layer C having second load bearing warp yarns extending in the machine direction, thus doubling the number of load bearing warp yarns. Respective ones of the first and second warp yarns of said first and second warp layers are arranged in the weave pattern to define stacked pairs of warp yarns. A warp balancing weft yarn is woven in a cross-machine direction with the first and second load bearing warp yarns to balance and maintain the warp yarns in the stacked pairs. By spacing the stacked pairs of warp yarns in the cross-machine direction, a desired fabric permeability can be provided without sacrificing the increased fabric stability of the fabric in the machine direction. It has been found quite advantageous that if the weft yarn 40 from a single weft system is woven in a four-shed repeat pattern, that the stacked configuration of the warp yarns can be provided. In the four-shed repeat pattern, the weft yarn passes over both of the yarns in a first stacked pair 52, between the warp yarns of a second stacked pair 54, under both of the warp yarns in a third stacked pair, and between the warp yarns of a fourth stacked pair 56. This repeat pattern has been found to effectively resist the tendency of the stacked warp yarns to shift relative to each other in a lateral direction, thus maintaining them in their vertical orientation on top of each other. In practice, the stacked pairs of warp yarns are spaced in the cross-machine direction to provide a projected fabric open area of at least thirty percent of the total fabric area.

While the term yarn has been used throughout the application, it is to be understood that the term yarn encompasses a monofilament element as well as a multifilament element. The same is true when the term yarn is used in the plural sense.

While a preferred embodiment of the invention has been described using specific terms, such description is for illustrative purposes only, and it is to be understood that changes and variations may be made without departing from the spirit or scope of the following claims.

What is claimed is:

1. A woven multilayer papermaking fabric for use with a papermaking machine having a paper support side and a roller contact side, said fabric having a weft yarn system with yarns extending in the cross machine direction of said papermaking machine and a multiple layer warp yarn system with yarns extending in the machine direction of said papermaking machine and normal to said first direction, wherein said multiple layer warp yarn system includes monofilament yarns selected from one of an oval and rectangular cross-section yarns arranged in at least first and second warp yarn layers one on top of the other in a superposed configuration to define at least pairs of stacked load bearing warp yarns extending in said machine direction along the entire fabric length, said stacked arrangement facilitating increased fabric stability; and said weft yarn system includes said weft yarns disposed in said cross-machine direction in a weave pattern which stabilizes said stacked warp yarns and adjacent ones of said stacked warp yarns layers being relatively positioned in said cross machine direction across said fabric to provide a desired degree of permeability.

2. The fabric of claim 1 wherein said warp yarns of said upper warp layer repeatedly pass under one and over three picks of said weft yarns.

3. The fabric of claim 2 wherein said warp yarns of said lower warp layer repeatedly pass over two, under one, and over one of corresponding ones of picks of said weft yarn.

4. A woven multilayer papermaking machine fabric having increased fabric stability in the machine direction of a papermaking machine comprising:

an upper warp layer of load bearing warp yarns forming a support surface, said upper layer of warp yarns, which extend in said machine direction, having a cross-section of a first configuration;

a lower warp layer of load bearing warp yarns which extend in said machine direction having a cross-section of a second configuration;

stacked warp yarn pairs defined by respective ones of said upper and lower warp yarn layer arranged in a generally vertically stacked relation one over the other along the entire fabric length;

said stacked warp yarn pairs being arranged adjacent one another in a desired relationship transverse said fabric to provide a desired fabric permeability;

a weft yarn system which includes weft yarns having a cross-section of a third configuration interwoven with said first and second warp yarn layers to bind with said respective ones of said upper and lower warp yarns to maintain said stacked pairs in said vertical arrangement; and at least one of said first, second, and third configurations having a non-circular cross section.

5. The fabric of claim 4 wherein said cross-section of said first configuration of said upper layer warp yarns is selected from one of a rectangular and oval cross-section yarns, and said second configuration and said third configuration are circular cross-section yarns.

6. The fabric of claim 4 wherein said cross-section of said first configuration of said upper warp yarns and said second configuration of said lower warp yarns is one of oval or rectangular.

7. The fabric of claim 4 wherein said cross-section of said first and second configurations are the same and differ from said third cross-section configuration.

8. The fabric of claim 4 wherein said warp yarns of said upper warp layer repeatedly pass under one and over three picks of said weft yarns.

9. The fabric of claim 8 wherein said warp yarns of said lower warp layer repeatedly pass under two, over one, and under one of corresponding ones of picks of said weft yarn.

10. The fabric of claim 4 wherein said weft yarns of said weft yarn system is woven in a four-shed repeat pattern over the warp yarns of a first stacked pair, between the warp yarns of a second stacked pair, under the warp yarns of a third stacked pair, and between the warp yarns of a fourth stacked pair.

11. The fabric of claim 4 wherein said cross-section of said configuration of said upper warp yarns, said second configuration of said lower warp yarns, and said third configuration of said weft yarn system are the same.

* * * * *